US011016431B2

(12) United States Patent
Hasegawa et al.

(10) Patent No.: US 11,016,431 B2
(45) Date of Patent: May 25, 2021

(54) IMAGE FORMING APPARATUS INCLUDING A CONTROLLER CONFIGURED TO CONTROL SWITCHING BETWEEN A FIRST MODE AND SECOND MODE

(71) Applicant: FUJI XEROX CO., LTD., Tokyo (JP)

(72) Inventors: Makoto Hasegawa, Kanagawa (JP); Yasutaka Naito, Kanagawa (JP); Noriyuki Miyoshi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/864,227

(22) Filed: May 1, 2020

(65) Prior Publication Data

US 2021/0011403 A1 Jan. 14, 2021

(30) Foreign Application Priority Data

Jul. 10, 2019 (JP) ..... JP2019-128741

(51) Int. Cl.
*G03G 15/00* (2006.01)
*G03G 15/20* (2006.01)

(52) U.S. Cl.
CPC ..... *G03G 15/657* (2013.01); *G03G 15/2025* (2013.01); *G03G 15/2053* (2013.01); *G03G 15/2064* (2013.01); *G03G 15/6529* (2013.01); *G03G 2215/00531* (2013.01); *G03G 2215/00949* (2013.01); *G03G 2215/2032* (2013.01)

(58) Field of Classification Search
CPC ..... G03G 15/2025; G03G 15/2028; G03G 15/657; G03G 15/5062; G03G 2215/00413; G03G 2215/00531; G03G 2215/00949
USPC ..... 399/15, 68, 322, 329, 400
See application file for complete search history.

(56) References Cited

U.S. PATENT DOCUMENTS 3,706,491 A * 12/1972 Furman ..... G03G 15/2025 355/133
5,153,964 A * 10/1992 Gelardi ..... G03G 15/6573 15/210.1
6,094,559 A * 7/2000 Otsuka ..... G03G 15/2025 399/327
9,063,481 B2 * 6/2015 Murakami ..... G03G 15/2028
(Continued)

FOREIGN PATENT DOCUMENTS

JP 60263182 A * 12/1985
JP 02063085 A * 3/1990
JP 2003295731 A * 10/2003
(Continued)

*Primary Examiner* — Robert B Beatty
(74) *Attorney, Agent, or Firm* — Sughrue Mion, PLLC

(57) ABSTRACT

An image forming apparatus includes a fixing device and a controller. The fixing device includes a heating unit and a pressurizing unit. The heating unit is configured to come into contact with a recording medium, onto which an image is transferred and which is transported, so as to heat the recording medium while rotating. The pressurizing unit is configured to press the recording medium against the heating unit. The fixing device is configured to fix the image to the recording medium. The controller is configured to control switching between a first mode for fixing the image to the recording medium and a second mode for making a transport speed of a sheet member that passes through the fixing device slower than a peripheral speed of the heating unit.

19 Claims, 12 Drawing Sheets

(56) References Cited

U.S. PATENT DOCUMENTS

2019/0018351 A1 1/2019 Hirose et al.

FOREIGN PATENT DOCUMENTS

| | | | | |
|---|---|---|---|---|
| JP | 2009175601 | A | * | 8/2009 |
| JP | 2012-98514 | A | | 5/2012 |
| JP | 2014095836 | A | * | 5/2014 |
| JP | 2014-232215 | A | | 12/2014 |
| JP | 2017-116651 | A | | 6/2017 |
| JP | 2017223826 | A | * | 12/2017 |
| JP | 2019-20443 | A | | 2/2019 |

* cited by examiner

FIG.9

| EVALUATION SPECIFICATION NO. | CONTENTS OF EVALUATION SPECIFICATION | EVALUATION RESULTS |
|---|---|---|
| 01 | SECOND MODE IS NOT PROVIDED | B |
| 02 | SECOND MODE IS PROVIDED, FIXING BELT CIRCULATES FOR 30 SECONDS | A |
| 03 | SECOND MODE IS PROVIDED, FIXING BELT CIRCULATES FOR 60 SECONDS | AA |

IMAGE FORMING APPARATUS INCLUDING A CONTROLLER CONFIGURED TO CONTROL SWITCHING BETWEEN A FIRST MODE AND SECOND MODE

CROSS-REFERENCE TO RELATED APPLICATIONS

This application is based on and claims priority under 35 USC 119 from Japanese Patent Application No. 2019-128741 filed Jul. 10, 2019.

BACKGROUND

1. Technical Field

The present disclosure relates to an image forming apparatus.

2. Related Art

In a fixing device disclosed in JP-A-2010-246093, an external beating roller and a refresh roller are configured to be movable with respect to a fixing roller. That is, switching is performed among the following states: a state where the external heating roller is only brought into contact with the fixing roller such that the refresh roller is separated from the fixing roller (at the fixing time); a state where the external heating roller is only separated from the fixing roller such that the refresh roller comes into contact with the fixing roller (after the end of printing), and a state where the external heating roller and the refresh roller are separated from the fixing roller (home position).

SUMMARY

An image transferred onto a recording medium is fixed to the recording medium by sandwiching the recording medium between a rotating heating unit and a rotating pressurizing unit. When a large number of recording media having the same size are sandwiched between the heating unit and the pressurizing unit, edge flaws occur on the peripheral surface of the heating unit due to edges of the recording media. The edge flaws occurring on the peripheral surface may deteriorate an image quality. As a countermeasure, the fixing device of the related art uses the refresh roller that rotates by being driven by the rotating heating unit. Here, when the refresh roller is used, it is necessary to secure a space where the refresh roller is disposed in the vicinity of the heating unit.

Aspects of non-limiting embodiments of the present disclosure relate to preventing deterioration of image quality caused by edge flaws occurring on a heating unit, without securing a space where a refresh roller is disposed.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including a fixing device and a controller. The fixing device includes a heating unit and a pressurizing unit. The heating unit is configured to come into contact with a recording medium, onto which an image is transferred and which is transported, so as to heat the recording medium while rotating. The pressurizing unit is configured to press the recording medium against the heating unit. The fixing device is configured to fix the image to the recording medium. The controller is configured to control switching between a first mode for fixing the image to the recording medium and a second mode for making a transport speed of a sheet member that passes through the fixing device slower than a peripheral speed of the heating unit.

BRIEF DESCRIPTION OF THE DRAWINGS

Exemplary embodiment(s) of the present disclosure will be described in detail based on the following figures, wherein:

FIG. 9 is a view illustrating evaluation results of evaluating the image forming apparatus according to the first exemplary embodiment of the present disclosure;

DETAILED DESCRIPTION

First Exemplary Embodiment

An example of an image forming apparatus according to a first exemplary embodiment of the present disclosure will be described with reference to FIGS. 1 to 11. Additionally, in each drawing, an arrow H indicates an upward-and-downward direction (that is, vertical direction) of the apparatus, and an arrow W indicates a width direction (that is, horizontal direction) of the apparatus.

(Entire Configuration of Image Forming Apparatus)

Figure 11:
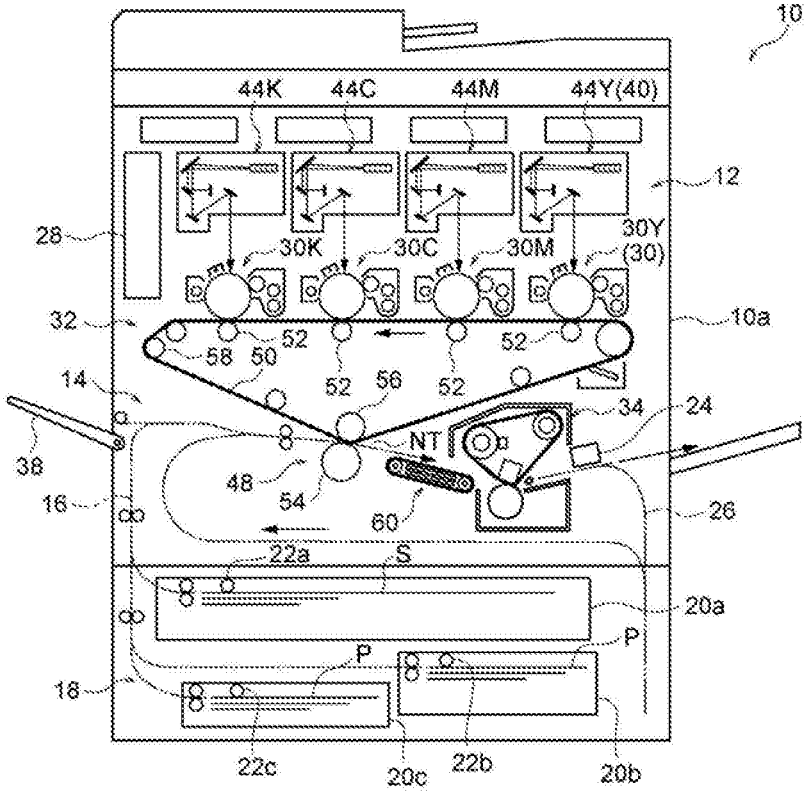
FIG. 11 is a schematic configuration view illustrating the image forming apparatus according to the first exemplary embodiment of the present disclosure.

As illustrated in FIG. 11, an image forming apparatus 10 includes an image forming unit 12 that forms toner images using an electrophotographic method, a transport unit 14 that transports a recording medium P along a transport path 16, and a manual feed tray 38 that is able to supply the recording medium P from the outside.

Further, the image forming apparatus 10 includes an image inspecting unit 24 that inspects an image formed on the recording medium P, an accommodating unit 18 that accommodates the recording medium P, and a controller 28 that controls each unit. Further, the image forming apparatus 10 includes a reverse path 26 in which the recording medium P with an image formed on the front page thereof is transported again toward the image forming unit 12 in the way that the front and back pages of the recording medium P are reversed, in order to form images on both pages of the recording medium P (duplex printing).

In the image forming apparatus 10 configured as described above, toner images formed in the image forming unit 12 are formed on the front page of the recording medium P transported along the transport path 16. Further, the recording medium P on which the toner images have been formed is ejected to the outside of the apparatus through the image inspecting unit 24.

Meanwhile, when an image is to be formed on the back page of the recording medium P, the recording medium P with the image formed on the front page thereof is transported along the reverse path 26, and an image is formed again on the back page of the recording medium P in the image forming unit 12.

[Image Forming Unit 12]

As illustrated in FIG. 11, the image forming unit 12 includes plural toner image forming units 30 that form toner images in different colors, respectively, and a transfer unit 32 that transfers the toner images formed by the toner image forming units 30 onto the recording medium P. Further, the image forming unit 12 includes a fixing device 34 that fixes the toner images transferred onto the recording medium P by the transfer unit 32, to the recording medium P.

—Toner Image Forming Units 30—

Plural toner image forming units 30 form toner images of different colors, respectively. In the present exemplary embodiment, total four toner image forming units 30 are provided for yellow (Y), magenta (M), cyan (C), and black (K), respectively. Hereinafter, when yellow (Y), magenta (M), cyan (C), and black (K) do not need to be discriminated, the symbols Y, M, C, and K will be omitted.

Figure 10:
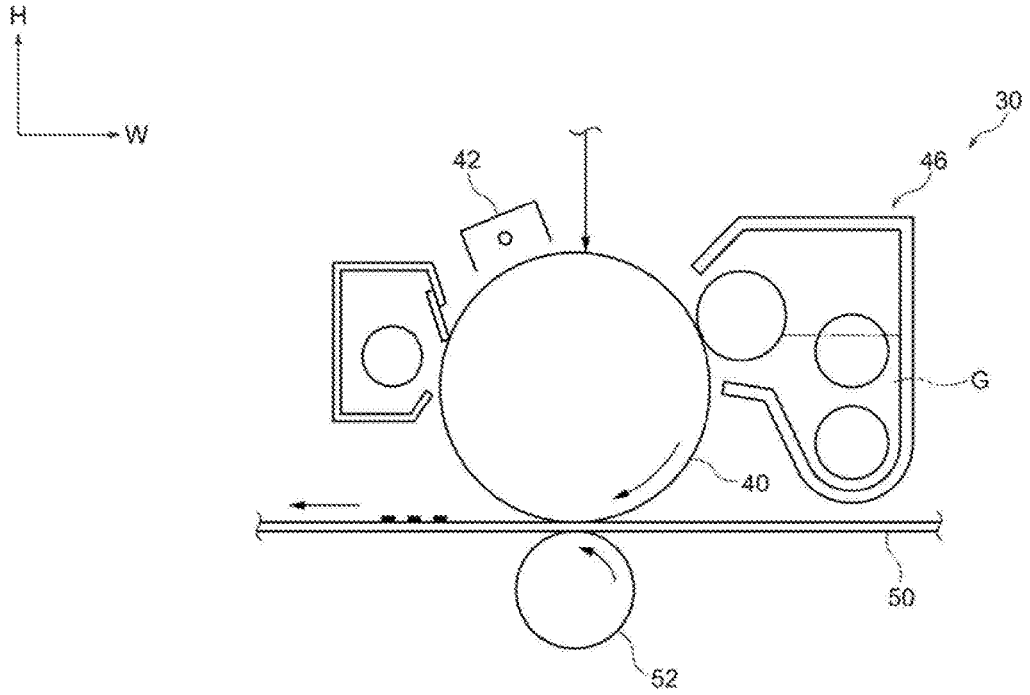
FIG. 10 is a schematic configuration view illustrating a toner image forming unit of the image forming apparatus according to the first exemplary embodiment of the present disclosure.

The toner image forming units 30 for the different colors basically have the same configuration, except for the toner that is used by each toner image forming unit 30. As illustrated in FIG. 10, each toner image forming unit 30 includes a rotating cylindrical image carrier 40 and a charger 42 that charges the image carrier 40. Further, the toner image forming unit 30 includes an exposure device 44 that irradiates the charged image carrier 40 with exposure light to form an electrostatic latent image (see FIG. 11), and a developing device 46 that develops the electrostatic latent image into a toner image using a developer G containing a toner. Accordingly, the toner image forming units 30 for the different colors form images in the respective colors, using the corresponding toners of the colors.

In addition, as illustrated in FIG. 11, the image carriers 40 for the different colors are in contact with a transfer belt 50 that travels in a circulating manner (to be described in detail later). Further, the toner image forming units 30 for yellow (Y), magenta (M), cyan (C), and black (K) are arranged horizontally side by side in this order from the upstream of the transfer belt 50 in the circulating direction thereof (see the arrow in FIG. 11).

—Transfer Unit 32—

As illustrated in FIG. 11, the transfer unit 32 includes the transfer belt 50 that is wrapped around plural rollers (reference numerals of the rollers are omitted) and circulates in the direction indicated by the arrow in FIG. 11, and primary transfer rollers 52 that are arranged on the opposite sides to the image carriers 40 for the different colors, respectively, in a state where the transfer belt 50 is sandwiched between the primary transfer rollers 52 and the image carriers 40, and transfer the toner images formed on the image carriers 40 for the different colors onto the transfer belt 50.

Further, the transfer unit 32 includes a winding roller 56 around which the transfer belt 50 is wrapped, and a secondary transfer roller 54 that is disposed on the opposite side to the winding roller 56 in a state where the transfer belt 50 is sandwiched between the secondary transfer roller 54 and the winding roller 56, and transfers the toner images transferred onto the transfer belt 50, onto the recording medium P. Further, the transfer unit 32 includes a driving roller 58 around which the transfer belt 50 is wrapped such that a rotating force is transmitted to the transfer belt 50. In addition, a transfer nip NT is formed between the secondary transfer roller 54 and the transfer belt 50 to transfer the toner images onto the recording medium P.

In this configuration, toner images are primarily transferred onto the transfer belt 50 by the primary transfer rollers 52 in an order of yellow (Y), magenta (M), cyan (C), and black (K). Meanwhile, the toner images are transferred from the transfer belt 50 onto the recording medium P that is transported in a state of being sandwiched between the transfer belt 50 and the secondary transfer roller 54. Further, the recording medium P onto which the toner images have been transferred is delivered to the fixing device 34 through a belt unit 60 to be described later.

As described above, a delivery member 48 includes the driving roller 58, the transfer belt 50, the winding roller 56, and the secondary transfer roller 54. The delivery member 48 delivers the recording medium P to the fixing device 34.

[Transport Unit 14]

As illustrated in FIG. 11, the transport unit 14 includes plural transport rollers that transport the recording medium P along the transport path 16 (reference numerals of the transport rollers are omitted), and the belt unit 60 that transports the recording medium P onto which the toner images have been transferred, to the fixing device 34.

Figure 4:
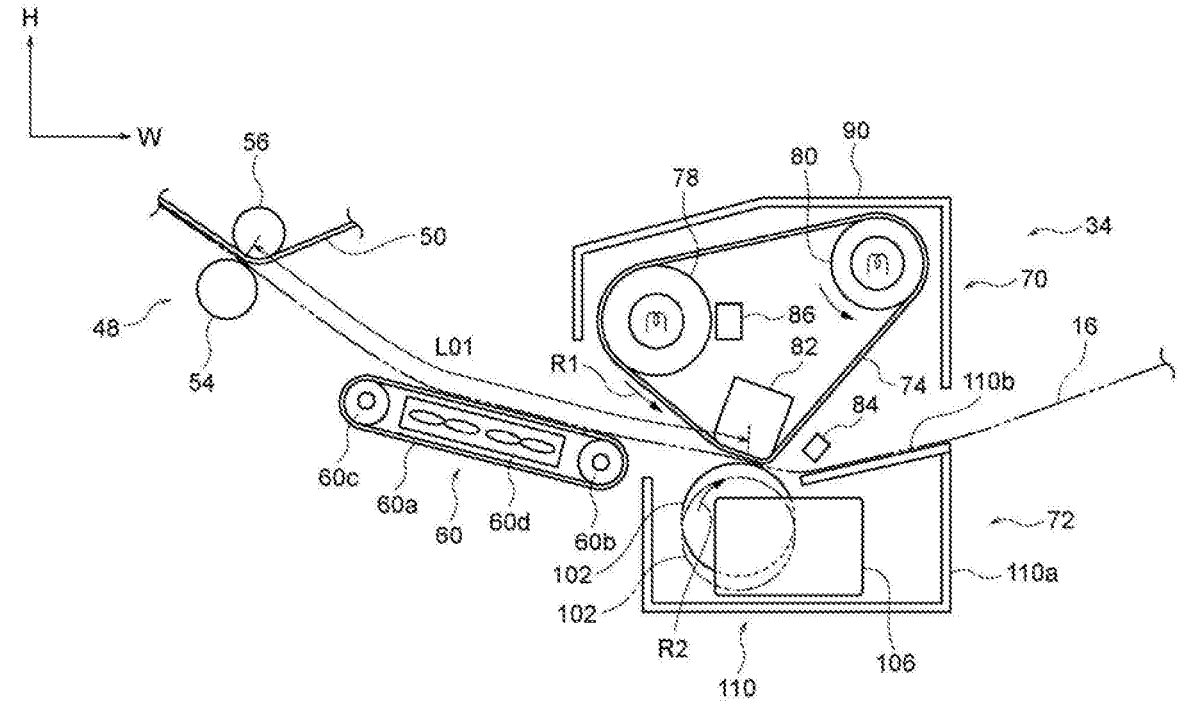
FIG. 4 is a configuration view illustrating the fixing device in the image forming apparatus according to the first exemplary embodiment of the present disclosure.

As illustrated in FIG. 4, the belt unit 60 includes an endless transport belt 60*a*, a driving roller 60*b* and a driven roller 60*c* around which the transport belt 60*a* is wrapped, and an air intake unit 60*d* that sucks the air inside the transport belt 60*a*.

In this configuration, the rotating driving roller 60*b* transmits the rotating force to the transport belt 60*a*, such that the transport belt 60*a* circulates. Further, the air intake unit 60*d* disposed inside the transport belt 60*a* sucks the air. As a result, the belt unit 60 transports the recording medium P while causing the recording medium P to be adsorbed to the transport belt 60*a*.

[Fixing Device 34]

As illustrated in FIG. 11, the fixing device 34 is disposed downstream of the belt unit 60 in the transport direction of the recording medium P. The fixing device 34 fixes the toner images transferred onto the recording medium P, to the recording medium P, by heating and pressing the toner images. In addition, the configuration of the fixing device 34 will be described in detail later.

[Image Inspecting Unit 24]

As illustrated in FIG. 11, the image inspecting unit 24 is disposed downstream of the fixing device 34 in the transport direction of the recording medium P. The image inspecting unit 24 is an inline sensor, and inspects an image formed on the recording medium P by irradiating the recording medium P with light and receiving the reflected light.

[Reverse Path 26]

As illustrated in FIG. 11, the recording medium P that has passed through the image inspecting unit 24 is sent to the reverse path 26. In the reverse path 26, the recording medium P is transported in the reverse direction to the transport direction of the recording medium P (switching-back transport), such that the front and back pages of the recording medium P are reversed. Then, for the duplex printing, the recording medium P with an image formed on the front page thereof is transported along the reverse path 26 such that the front and back pages of the recording medium P are reversed, and is transported again toward the image forming unit 12.

[Manual Feed Tray 38]

The manual feed tray 38 is openable on the lateral side of an apparatus body 10 of the image forming apparatus 10. Accordingly, when the user places the recording medium P on the manual feed tray 38, and designates the manual feed tray 38, the recording medium P placed on the manual feed tray 38 is transported to the image forming unit 12.

[Accommodating Unit 18]

The accommodating unit 18 includes three accommodating trays 20*a*, 20*b*, and 20*c* that are able to accommodate recording media P, and delivery rollers 22*a*, 22*b*, and 22*c* that deliver the recording media P accommodated in the accommodating trays 20*a*, 20*b*, and 20*c*, respectively, to the transport path 16.

The recording media P may be stacked in each of the three accommodating trays 20*a*, 20*b*, and 20*c*, and the accommodating trays 20*b* and 20*c* are arranged side by side in the width direction of the apparatus at the lower portion of the apparatus body 10*a* of the image forming apparatus 10. Further, the accommodating tray 20*a* is disposed above the accommodating trays 20*b* and 20*c*, and recording media P having a larger size than that for the accommodating trays 20*b* and 20*c* may be stacked in the accommodating tray 20*a*.

The delivery rollers 22*a*, 22*b*, and 22*c* deliver the uppermost recording media P stacked in the accommodating trays 20*a*, 20*b*, and 20*c*, respectively, to the transport path 16.

In the present exemplary embodiment, A3-size embossed sheets S on which images are formable are stacked in the accommodating tray 20*a*, A4-size recording media P on which images are formable are stacked in the accommodating tray 20*b*, and B4-size recording media P on which images are formable are stacked in the accommodating tray 20*c*. That is, the accommodating tray 20*a* accommodates an embossed sheet S having the maximum width up to which the image forming apparatus 10 can form an image. The embossed sheet S is an example of a sheet member.

Here, the "embossed sheet S" refers to a paper on which concave-convex patterns are formed, and the embossing height is, for example, 0.1 mm or more and 1 mm or lower.

In addition, the "recording medium or sheet member having the maximum width up to which an image is formable" refers to a recording medium or sheet member which is the widest to the extent that an image can be formed using the image forming apparatus 10. In other words, the "recording medium or sheet member" above refers to a recording medium or sheet member which is the widest to the extent that the recording medium or sheet member can be transported using the image forming apparatus 10.

(Configuration of Fixing Device 34)

Next, the fixing device 34 will be described. As illustrated in FIG. 4, the fixing device 34 includes a heating unit 70 that heats the recording medium P, and a pressurizing unit 72 that presses the recording medium P toward the heating unit 70. The heating unit 70 and the pressurizing unit 72 are arranged vertically, and the heating unit 70 is disposed above the pressurizing unit 72.

[Heating Unit 70]

Figure 8:
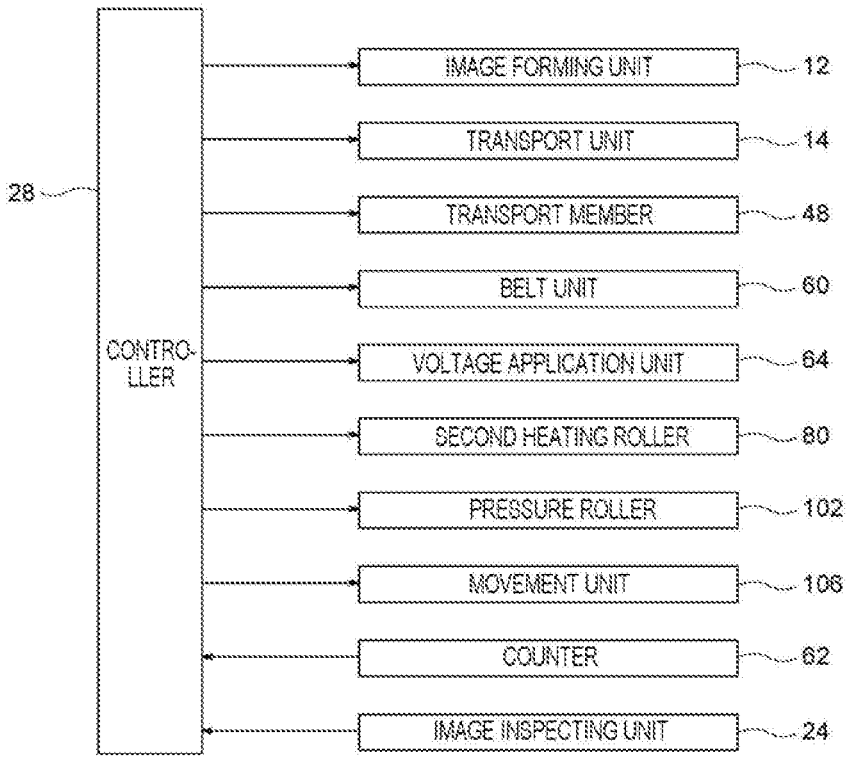
FIG. 8 is a block diagram illustrating a controller of the image forming apparatus according to the first exemplary embodiment of the present disclosure.

As illustrated in FIG. 4, the heating unit 70 includes an endless fixing belt 74, a first heating roller 78 that heats the fixing belt 74, a second heating roller 80 that heats the fixing belt 74, and a pad member 82 around which the fixing belt 74 is wrapped. Further, the heating unit 70 includes a temperature sensor 86 that detects a temperature of the peripheral surface of the first heating roller 78, a leading edge sensor 84 that detects a leading edge of the recording medium P which is being transported, and an upper cover 90 that covers the respective members from above. Further, the heating unit 70 includes a voltage application unit 64 that applies a voltage to a halogen heater disposed inside the first heating roller 78 and a halogen heater disposed inside the second heating roller 80 (FIG. 8).

—Fixing Belt 74—

The fixing belt 74 has an endless shape, and is formed by coating the surface of a base material made of, for example, polyamide with a fluororesin. Then, the fixing belt 74 is wrapped around the first heating roller 78, the second heating roller 80, and the pad member 82, in a posture in which the lower portion of the fixing belt 74 becomes a vertex of a triangle. The fixing belt 74 is an example of a heating unit.

—Pad Member 82—

The pad member 82 is disposed below the first heating roller 78 and the second heating roller 80, and the lower vertex portion of the fixing belt 74 is wrapped around the pad member 82. Further, the pad member 82 extends in the depth direction of the apparatus, and has a rectangular cross section.

In addition, the pad member 82 is attached to frame members (not illustrated) at both end portions thereof in the depth direction of the apparatus.

In this configuration, the pad member 82 receives a nip load from a pressure roller 102 that makes up the pressurizing unit 72 as described later, such that a nip portion N is formed between the fixing belt 74 and the pressure roller 102.

In addition, the distance along the transport path 16 from the nip portion N to the portion where the secondary transfer roller 54 and the transfer belt 50 are in contact with each other (L01 in FIG. 4) is shorter than the longitudinal length of the recording medium P having the minimum size on which an image is formable by the image forming apparatus 10.

—First Heating Roller 78 and Second Heating Roller 80—

The first heating roller 78 is disposed above a one-side area from the pad member 82 in the width direction of the apparatus (left-side area in FIG. 4), and the axial direction thereof is directed toward the depth direction of the apparatus. In addition, the first heating roller 78 includes the halogen heater inside. Further, the first heating roller 78 is rotatably attached to frame members (not illustrated) at both end portions thereof in the depth direction of the apparatus.

The second heating roller 80 is disposed above the other-side area from the pad member 82 in the width direction of the apparatus (right-side area in FIG. 4), and the axial direction thereof is directed toward the depth direction of the apparatus. In addition, the second heating roller 80 includes the halogen heater inside. Further, the second heating roller 80 is attached to frame members (not illustrated) at both the end portions thereof in the depth direction of the apparatus, and rotates by a rotating force transmitted from a driving source.

In this configuration, when the second heating roller 80 rotates, the fixing belt 74 circulates in the direction of the arrow R1 in FIG. 4 in a state of maintaining its posture. Further, the first heating roller 78 rotates by being driven by the circulating fixing belt 74.

In addition, when the voltage application unit 64 applies a voltage to the halogen heaters, the temperatures of the first heating roller 78 and the second heating roller 80 increase. Further, the temperature of the fixing belt 74 increases by the increase in temperatures of the first heating roller 78 and the second heating roller 80.

As a result, the fixing belt 74 comes into contact with a recording medium P, onto which an image is transferred and which is transported, so as to heat the recording medium P, while rotating.

—Leading Edge Sensor 84—

The leading edge sensor 84 is disposed downstream of the nip portion N in the transport direction of the recording medium P above the transport path 16, and detects the leading edge of the recording medium P that is being transported.

—Upper Cover 90—

The upper cover 90 is disposed so as to cover the area above the fixing belt 74 from above, and extends in the depth direction of the apparatus. In addition, the cross section of the upper cover 90 taken along the plane orthogonal to the depth direction of the apparatus has a U shape that opens downward.

In this configuration, the upper cover 90 prevents the upward movement of air heated by the increase of the temperature of the fixing belt 74, so that the heat of the fixing belt 74 does not escape upward.

[Pressurizing Unit 72]

As illustrated in FIG. 4, the pressurizing unit 72 includes the pressure roller 102 that presses the recording medium P against the fixing belt 74, and movement units 106 that move the pressure roller 102 in a direction in which the pressure roller 102 approaches or is separated from the fixing belt 74, and a lower cover 110 that covers the respective members from below.

—Pressure Roller 102—

The pressure roller 102 is disposed on the opposite side to the pad member 82 such that the fixing belt 74 is sandwiched between the pressure roller 102 and the pad member 82, and the axial direction thereof is directed toward the depth direction of the apparatus. The pressure roller 102 is formed by coating the outer periphery of a cylindrical roller body (not illustrated) made of, for example, aluminum with an elastic layer made of silicone rubber. In addition, a separation layer made of, for example, a fluorine-based resin is formed on the peripheral surface of the elastic layer. The pressure roller 102 is an example of a pressurizing unit.

Further, the pressure roller 102 is attached to the movement units 106 at both end portions thereof in the depth direction of the apparatus, and when a rotating force is transmitted from a driving source (not illustrated), the pressure roller 102 rotates in the direction of the arrow R2 in FIG. 4.

—Movement Units 106—

A pair of movement units 106 is arranged at both ends of the pressure roller 102, and formed by combining well-known mechanical components with each other.

In this configuration, the movement units 106 move the pressure roller 102 in the direction in which the pressure roller 102 approaches or is separated from the portion of the fixing belt 74 that is wrapped around the pad member 82. Specifically, when the fixing device 34 fixes toner images to the recording medium P, the movement units 106 move the pressure roller 102 to a contact position where the recording medium P that is being transported in contact with the fixing belt 74 is pressed against the fixing belt 74 (see the solid line in FIG. 4). Meanwhile, when the fixing device 34 is in a non-operating state, and when the temperature of the fixing belt 74 is increased to a threshold, the movement units 106 move the pressure roller 102 to a separation position where the pressure roller 102 is separated from the fixing belt 74 (see the double chain line in FIG. 4). When the movement units 106 move the pressure roller 102 as described above, the pressing force with which the pressure roller 102 presses the recording medium P against the fixing belt 74 changes. Accordingly, the movement units 106 function as pressure adjustment units that adjust the strength of the pressing force with which the pressure roller 102 presses against the fixing belt 74.

In addition, when the fixing belt 74 circulates in a state where the pressure roller 102 is disposed at the separation position, the rotating force of the rotating second heating roller 80 is transmitted to the fixing belt 74. Meanwhile, when the fixing belt 74 circulates in a state where the pressure roller 102 is disposed at the contact position, the rotating force of the second heating roller 80 is released, and the rotating force of the rotating pressure roller 102 is transmitted to the fixing belt 74.

—Lower Cover 110—

The lower cover 110 is disposed so as to cover the pressure roller 102 and the movement units 106 from below, and extends in the depth direction of the apparatus. In addition, the lower cover 110 has a body 110*a* and a plate-shaped guide 110*b* that guides the recording medium P along the transport path 16.

The cross section of the body 110*a* taken along the plane orthogonal to the depth direction of the apparatus has a U shape that opens upward.

The guide 110*b* covers a portion of the opening of the body 110*a* downstream of the nip portion N in the transport direction of the recording medium P. In addition, the plate surface of the guide 110*b* is inclined such that one end of the guide 110*b* in the width direction of the apparatus is lower than the other end thereof when viewed from the depth direction of the apparatus.

Figure 3:
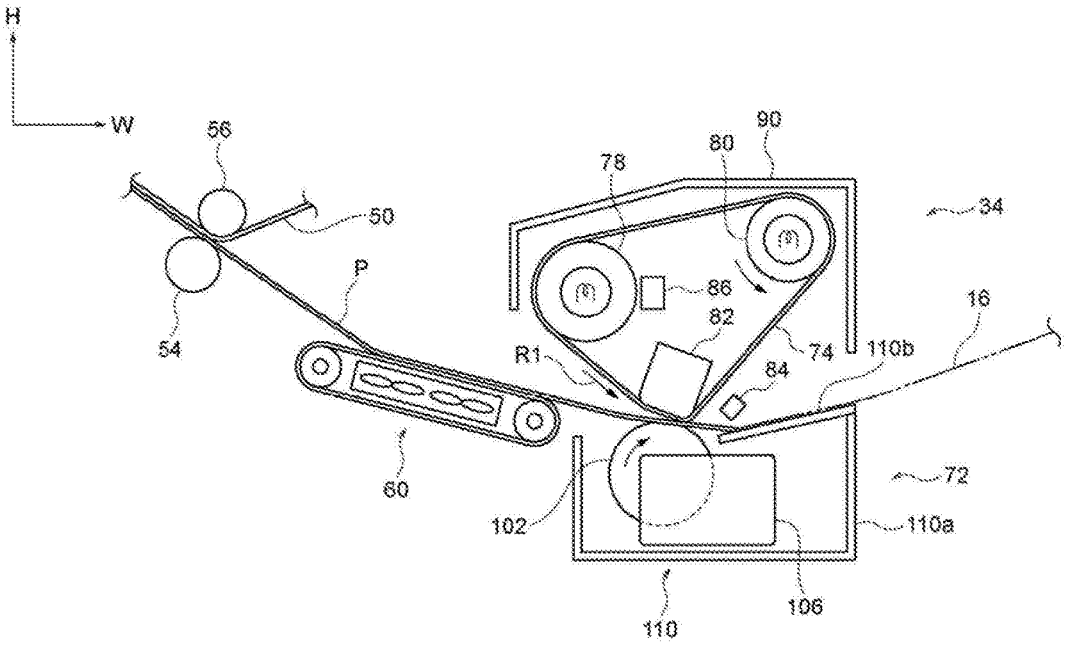
FIG. 3 is a configuration view illustrating the fixing device of the image forming apparatus according to the first exemplary embodiment of the present disclosure and is referred to in describing a first mode.

In this configuration, in a state where the pressure roller 102 is disposed at the contact position, the leading edge of the recording medium P sent from the nip portion N of the fixing device 34 comes into contact with the guide 110*b* from above, and the recording medium P is guided along the transport path 16, as illustrated in FIG. 3.

Figure 6:
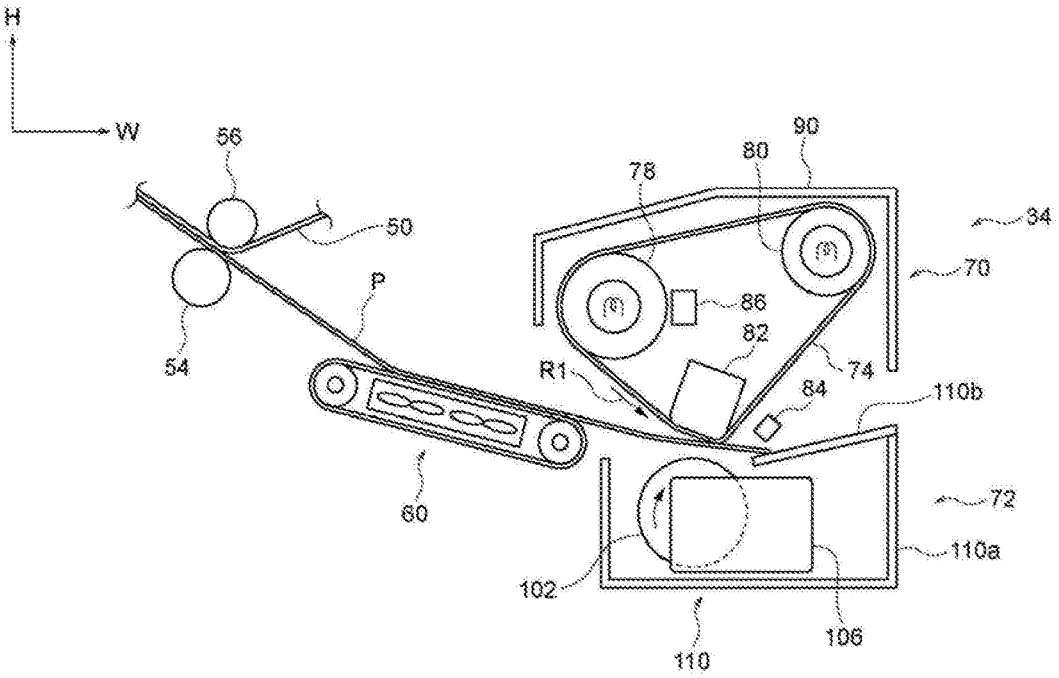
FIG. 6 is a configuration view illustrating the fixing device in the image forming apparatus according to the first exemplary embodiment of the present disclosure.

Here, the leading edge of the recording medium P sent from the nip portion N comes into contact with the guide 110*b* from above. In other words, the guide 110*b* supports the leading edge of the recording medium P from below. Accordingly, as illustrated in FIG. 6, even in a state where the pressure roller 102 is disposed at the separation position, the recording medium P comes into contact with the guide 110*b*, so that the contact between the recording medium P and the fixing belt 74 is maintained. In this way, the guide 110*b* functions as a contact maintaining unit that maintains the contact between the recording medium P and the fixing belt 74.

[Controller 28]

As illustrated in FIG. 8, the controller 28 controls each unit provided in the image forming apparatus 10. Further, the controller 28 controls switching between a first mode for fixing a toner image to the recording medium P and a second mode for restoring the fixing belt 74 having edge flaws caused by the edges of the recording media P. The control of each unit by the controller 28 will be described later together with the operation thereof.

[Miscellaneous]

The image forming apparatus 10 includes a counter 62 that counts the number of recording media P on which images have been formed, for each size (see FIG. 8).

(Operation of Image Forming Apparatus 10)

Next, operation of the image forming apparatus 10 will be described based on the flowchart illustrated in FIG. 7.

Figure 5:
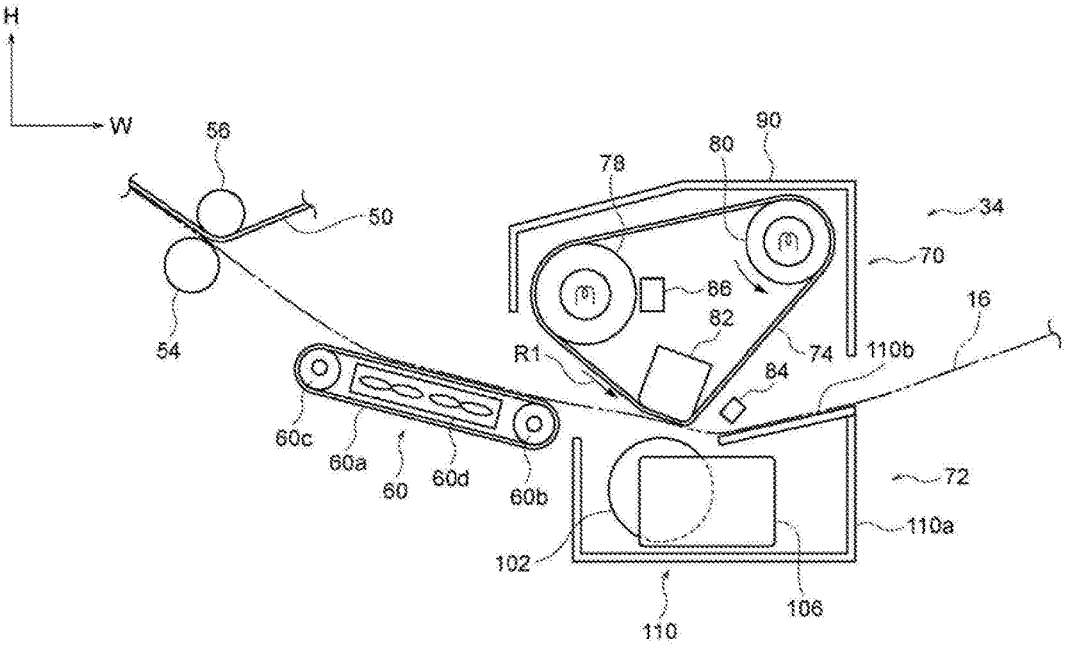
FIG. 5 is a configuration view illustrating the fixing device in the image forming apparatus according to the first exemplary embodiment of the present disclosure.

In a state where the image forming apparatus 10 is installed at an installation place and is in the non-operating state, the pressure roller 102 is disposed at the separation position where the pressure roller 102 is separated from the fixing belt 74, and the respective units of the image forming apparatus 10 are stopped, as illustrated in FIG. 5.

Figure 7:
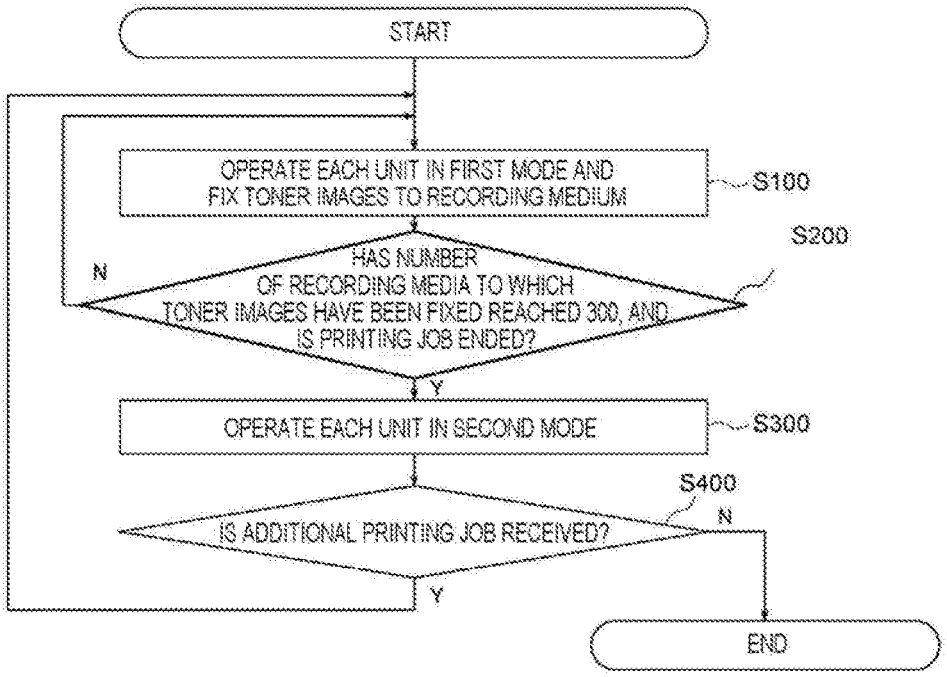
FIG. 7 is a flowchart illustrating the flow of the second mode in the image forming apparatus according to the first exemplary embodiment of the present disclosure.

When the image forming apparatus 10 operates such that a process for a printing job is started, the controller 28 operates each unit in the first mode for forming and fixing toner images onto the recording medium P, in step S100 illustrated in FIG. 7. Specifically, toner images are formed in the image forming unit 12 illustrated in FIG. 11. Further, in the fixing device 34 illustrated in FIG. 4, the voltage application unit 64 applies a voltage to the halogen heater inside the first heating roller 78 and the halogen heater inside the second heating roller 80, such that the second heating roller 80 transmits the rotating force to the fixing belt 74. Then, the temperature sensor 86 detects the temperature of the peripheral surface of the first heating roller 78, and when the temperature of the first heating roller 78 becomes equal to or higher than a threshold, the movement units 106 move the pressure roller 102 disposed at the separation position to the contact position. Additionally, the "printing job" refers to a process unit for a printing operation indicated by one printing instruction.

Further, the controller 28 controls the transport unit 14, and operates the transport rollers and the belt unit 60 to fix the toner images to the recording medium P. Specifically, the transport rollers that make up the transport unit 14 transport the recording medium P accommodated in the accommodating unit 18 along the transport path 16, and the toner images are transferred onto the recording medium P that is transported, in the transfer nip NT formed between the secondary transfer roller 54 and the transfer belt 50.

Then, the recording medium P, onto which the toner image is transferred and which is transported by the delivery member 48, is delivered to the belt unit 60. Then, the recording medium P is transported by the belt unit 60 while being sandwiched between the circulating fixing belt 74 and the pressure roller 102, such that the toner images formed on the recording medium P are heated, pressed, and fixed to the recording medium P.

When the toner images are fixed to one recording medium P by the fixing device 34, the process proceeds to step S200.

In step S200, the counter 62 (see FIG. 8) counts the number of recording media P to which toner images have been fixed by the fixing device 34, for each size. That is, in step S200, 1 is added to the number of recording media P previously counted by the counter 62. Then, the counter 62 stores the number of recording media P to which toner images have been continuously fixed by the fixing device 34, for each size.

For example, when toner images have been continuously fixed to 300 A4-size recording media P by the fixing device 34, and when the printing job ends, the controller 28 resets the number of recording media P counted by the counter 62 (back to zero). When the number of recording media P counted by the counter 62 is reset, the process proceeds to step S300. In addition, when the number of recording media P counted by the counter 62 does not reach the threshold of 300 or the printing job has not been ended, the process returns to step S100 such that toner images are formed and fixed to the recording medium P. In addition, the printing job may be pending for the 30 continuous recording media P.

Figure 2:
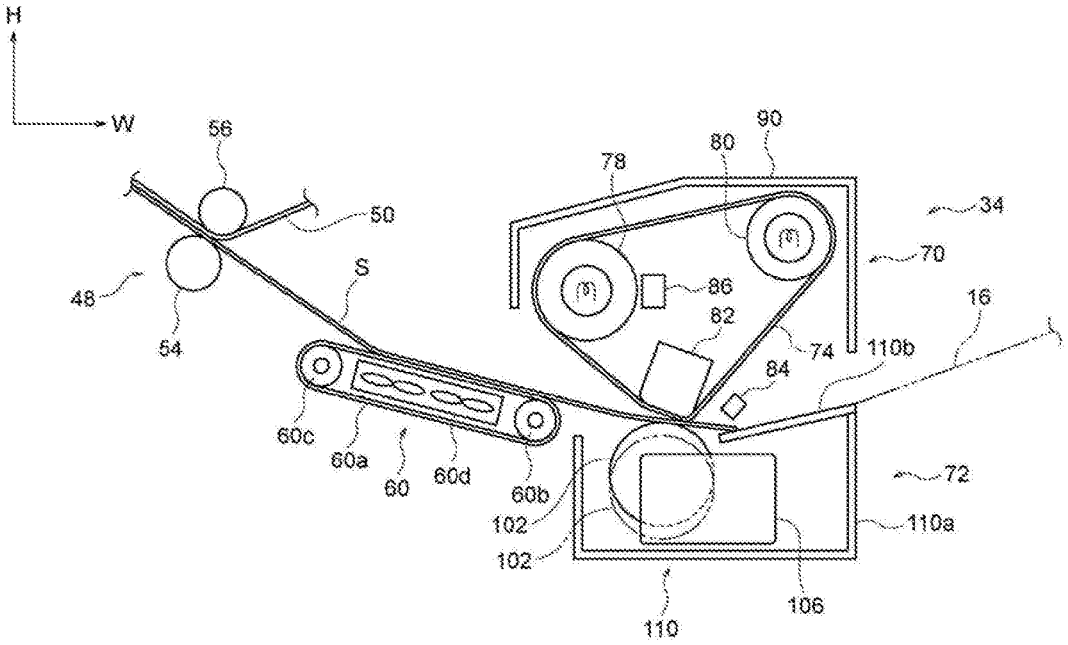
FIG. 2 is a configuration view illustrating the fixing device of the image forming apparatus according to the first exemplary embodiment of the present disclosure and is referred to in describing the second mode.

In step S300, the controller 28 switches the first mode of each unit to the second mode for restoring the fixing belt 74 having edge flaws caused by the continuous fixing of 300 recording media P. In the second mode, the controller 28 stops the operations of the toner image forming units 30 of the image forming unit 12. Further, the controller 28 controls the transport unit 14 to send the embossed sheet S that is accommodated in the accommodating tray 20*a*, to the transport path 16. Then, as illustrated in FIG. 2, when the leading edge sensor 84 detects the leading edge of the embossed sheet S that is being transported, the controller 28 controls the delivery member 48 to stop the operation of the delivery member 48, and controls the fixing device 34 to stop the operation of the fixing device 34. In this state, the leading edge of the embossed sheet S is in contact with the guide 110*b*.

Further, the controller 28 controls the movement units 106 to move the pressure roller 102 disposed at the contact position to the separation position (see the double chain line in FIG. 2). When the pressure roller 102 is moved to the separation position, the controller 28 controls the voltage application unit 64 (see FIG. 8) to apply a voltage to the halogen heater inside the first heating roller 78 and the halogen heater inside the second heating roller 80.

Figure 1:
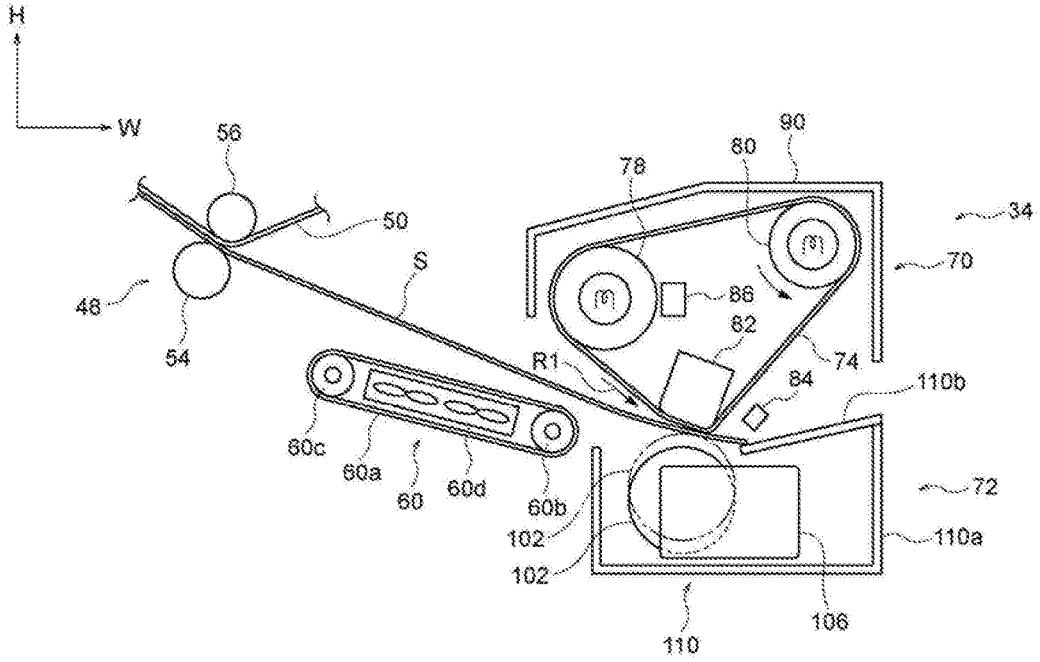
FIG. 1 is a configuration view illustrating a fixing device of an image forming apparatus according to a first exemplary embodiment of the present disclosure and is referred to in describing a second mode.

Further, as illustrated in FIG. 1, the controller 28 controls the second heating roller 80 to rotate the second heating roller 80, such that the fixing belt 74 circulates at the same peripheral speed as that in the first mode. In this way, when the delivery member 48 is stopped from transporting the embossed sheet S and the fixing belt 74 is circulated, a friction occurs between the embossed sheet S and the peripheral surface of the fixing belt 74. As a result of the friction, the state of the peripheral surface of the fixing belt 74 becomes uniform, so that the fixing belt 74 having the edge flaws is restored.

Then, when the fixing belt 74 circulates for a predetermined time (for example, for 30 seconds), the controller 28 controls the movement units 106 to move the pressure roller 102 disposed at the separation position to the contact position (see the double chain line in FIG. 1), so as to operate the pressure roller 102. Further, the controller 28 operates the delivery member 48 to eject the embossed sheet S to the outside of the apparatus body 10*a*, and then, stops the operation of each unit to end the second mode. When the second mode ends, the process proceeds to step S400.

In step S400, the controller 28 determines whether the image forming apparatus 10 receives an additional printing job, and when it is determined that the image forming apparatus 10 receives an additional printing job, the process returns to step S100 such that the controller 28 switches the second mode of each unit to the first mode to start the process of the printing job.

Meanwhile, when it is determined that the image forming apparatus 10 does not receive an additional printing job, the controller 28 makes the image forming apparatus 10 be in the non-operating state, and ends the series of operations.

(Evaluation)

An evaluation is conducted for a case where the second mode is provided, using Versant 180P manufactured by Fuji Xerox Co., Ltd., as an image forming apparatus. The evaluation is described below.

[Evaluation Specification-01]

In a state where the pressure roller is disposed at the contact position and the fixing belt is heated, 400 recording media P are caused to continuously pass through the fixing device. It is noted that no images are formed on the recording media P that pass through the fixing device. As for each recording medium P, A4-size New-DV (basis weight of 350 g/m$^2$) manufactured by Hokuetsu Co., Ltd., is used.

After the 400 recording media P are continuously transported to the fixing device, a blue solid image (area coverage of 100%) is formed using an A3-size OS-coated paper (basis weight of 127 g/m$^2$) manufactured by Fuji Xerox Co., Ltd. The image quality of the solid image is evaluated.

As described above, in "Evaluation Specification-01", the second mode is not provided.

[Evaluation Specification-02]

After Evaluation-01 is completed, an A3-size mermaid snow white (basis weight of 209 g/m$^2$) manufactured by Tokushu Tokai Paper Co., Ltd., is used as the embossed sheet S for the second mode. Then, the pressure roller 102 is moved to the separation position, the leading edge of the embossed sheet S is brought into contact with the guide 110*b*, the transport of the embossed sheet S is stopped, and in this state, the fixing belt 74 is caused to circulate for 30 seconds.

After the circulation of the fixing belt 74, the pressure roller 102 is moved to the contact position, and a blue solid image (area coverage of 100%) is formed using the A3-size OS-coated paper (basis weight of 127 g/m$^2$) manufactured by Fuji Xerox Co., Ltd. The image quality of the solid image is evaluated.

As described above, in "Evaluation Specification-02", the second mode is provided, and the fixing belt 74 is caused to circulate for 30 seconds.

[Evaluation Specification-03]

After Evaluation-02 is completed, the pressure roller 102 is moved to the separation position. Further, the leading edge of the A3-size mermaid snow white is brought into contact with the guide 110*b*, the transport of the embossed sheet S is stopped, and in this state, the fixing belt 74 is caused to further circulate for 30 seconds. That is, in consideration of Evaluation Specification-02, the fixing belt 74 is caused to circulate for a total of 60 seconds.

After the circulation of the fixing belt 74, the pressure roller 102 is moved to the contact position, and a blue solid image (area coverage of 100%) is formed using the A3-size OS-coated paper (basis weight of 127 g/m$^2$) manufactured by Fuji Xerox Co., Ltd. The image quality of the solid image is evaluated.

As described above, in "Evaluation Specification-03", the second mode is provided, and the fixing belt 74 is caused to circulate for a total of 60 seconds.

[Evaluation Results]

An evaluation is conducted on the image quality of the blue solid image formed on the OS-coated paper in each evaluation specification. The symbol "B" is given in a case where the deterioration of image quality caused by edge flaws of the fixing belt 74 is visually recognized, the symbol "A" is given in a case where the deterioration of image quality caused by edge flaws of the fixing belt 74 is visually recognized, but is allowable in terms of merchantability, and the symbol "AA" is given in a case where the deterioration of image quality caused by edge flaws of the fixing belt 74 is not visually recognized.

FIG. 9 represents the evaluation results in a table. As represented in the table, the evaluation result of "Evaluation Specification-01" in which the second mode is not provided is "B". In addition, the evaluation result of "Evaluation Specification-02" in which the second mode is provided and the fixing belt 74 is caused to circulate for 30 seconds is "A". Further, the evaluation result of "Evaluation Specification-03" in which the second mode is provided and the fixing belt 74 is caused to circulate for a total of 60 seconds is "AA".

SUMMARY

As seen from the evaluation results above, in the image forming apparatus 10, the deterioration of image quality caused by edge flaws of the fixing belt 74 is prevented by providing the second mode. In other words, in the image forming apparatus 10, the deterioration of image quality caused by edge flaws of the fixing belt 74 is prevented without securing a space where a refresh roller is disposed.

In addition, in the image forming apparatus 10, the embossed sheet S having the maximum width passes through the fixing device 34 in the second mode. As a result, it is possible to prevent the deterioration of quality of an image formed on a recording medium P having a size other than the minimum size on which an image is formable, without securing a space where a refresh roller is disposed.

In addition, in the image forming apparatus 10, the pressure roller 102 is disposed at the separation position in the second mode, such that the pressure applied to the embossed sheet S by the pressure roller 102 becomes weak. As a result, the difference between the transport speed of the embossed sheet S and the peripheral speed of the fixing belt 74 increases, as compared with a case where the pressure roller 102 is disposed at the contact position.

In addition, in the image forming apparatus 10, the delivery member 48 is stopped from transporting the embossed sheet S in the second mode. As a result, the time during which the state of the peripheral surface of the fixing belt 74 is made uniform by the friction generated between the embossed sheet S and the peripheral surface of the fixing belt 74 is reduced, as compared with a case where the embossed sheet S is transported by the delivery member 48. In other words, the time of the second mode is reduced, as compared with a case where the embossed sheet S is transported by the delivery member 48.

In addition, in the image forming apparatus 10, when the fixing device 34 continuously fixes toner images to 300 A4-size recording media P, and further, when the printing job ends, the first mode is switched to the second mode. The first mode is switched to the second mode when edge flaws are highly likely to occur in the fixing belt 74, as compared with a case where the first mode is also switched to the second mode when, while toner images are being fixed to recording media P having a predetermined width, toner images are fixed to recording media P having a width other than the predetermined width. In other words, the number of times for switching the first mode to the second mode is reduced.

In addition, in the image forming apparatus 10, the embossed sheet S is used as a sheet member in the second mode. As a result, the frictional force generated between the sheet member and the peripheral surface of the fixing belt 74 becomes strong, as compared with a case where a plain paper is used. In addition, the "plain paper" refers to paper that is used for an ordinary printing, and is, for example, the J paper (manufactured by Fuji Xerox Co., Ltd.).

In addition, since the frictional force generated between the sheet member and the peripheral surface of the fixing belt 74 becomes relatively strong, the time of the second mode is reduced, as compared with a case where the plain paper is used.

Second Exemplary Embodiment

An example of an image forming apparatus according to a second exemplary embodiment of the present disclosure will be described with reference to FIG. 12. In addition, the second exemplary Embodiment will be described focusing on differences from the first exemplary embodiment.

An image forming apparatus 210 according to the second exemplary embodiment includes an input unit 220 for switching the first mode to the second mode according to an input by a user, and a recommending unit 230 that recommends a user to switch the first mode to the second mode based on an inspection result of the image inspecting unit 24 (see FIG. 11).

Figure 12:
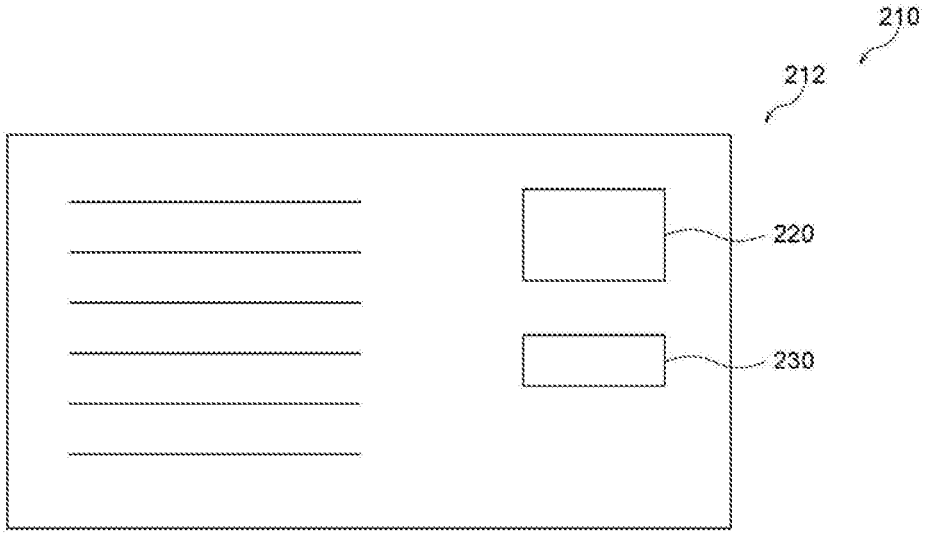
FIG. 12 is a conceptual view illustrating a user interface of an image forming apparatus according to a second exemplary embodiment of the present disclosure.

Specifically, as illustrated in FIG. 12, a user interface 212 of the image forming apparatus 210 displays the input unit 220 for switching the first mode to the second mode, and the recommending unit 230 that recommends a user to switch the first mode to the second mode.

In this configuration, when the controller 28 determines that the deterioration of image quality occurs due to edge flaws of the fixing belt 74, based on the inspection of the image inspecting unit 24, the recommending unit 230 that has been turned off is turned on. Then, when the user touches the input unit 220, the first mode is switched to the second mode. When the first mode is switched to the second mode by the user's touch of the input unit 220, the recommending unit 230 that has been turned on is turned off, and further, the number of sheets counted by the counter 62 (see FIG. 8) is reset.

As described above, in the image forming apparatus 210, the input unit 220 is provided, such that the first mode is switched to the second mode according to the user's intention.

In addition, in the image forming apparatus 210, since the recommending unit 230 is provided that recommends to switch the first mode to the second mode, the first mode is switched to the second mode by the user at an appropriate timing, as compared with a case where the recommending unit is not provided. The other operations of the second exemplary embodiment are the same as those of the first exemplary embodiment.

In addition, while the exemplary embodiments of the present disclosure have been described in detail, the present disclosure is not limited to the exemplary embodiments. It is obvious to one of ordinary skill in the art that other various exemplary embodiments may be taken in the scope of the present disclosure. For example, while the fixing belt 74 functions as the heating unit in the exemplary embodiments described above, the heating unit may be a roller-shaped heating roller.

In addition, in the exemplary embodiments described above, the sheet member with the maximum width is used in the second mode. However, the width of the sheet member used in the second mode has only to be wider than the minimum width of the recording medium P usable in the image forming apparatus 10 or 210. That is, the width of the sheet member has only to be wider than the width of the recording medium having the minimum size on which an image is formable.

In addition, in the exemplary embodiments described above, the pressing force of the pressure roller 102 is made weak in the second mode, as compared with the first mode, by providing the pressure roller 102 at the separation position. However, the pressing force of the pressure roller may be made weak in a state of maintaining the contact between the pressure roller and the fixing belt. As a result, the contact between the sheet member and the fixing belt is maintained in the second mode. In this case, the pressure roller is used as the contact maintaining unit.

In addition, in the exemplary embodiments described above, the friction between the sheet member and the peripheral surface of the fixing belt is generated in the second mode, by stopping the delivery member 48 from transporting the sheet member. Alternatively, the friction between the sheet member and the peripheral surface of the fixing belt may be generated by making the transport speed at which the delivery member transports the sheet member slower than the peripheral speed of the fixing belt. In this case, the operation achieved by stopping the delivery member from transporting the sheet member is not achieved in the second mode.

In addition, in the exemplary embodiments described above, the delivery member 48 is stopped from transporting the sheet member only once in the second mode. However, after the delivery member is stopped from transporting the sheet member, the delivery member may transport the sheet member, and the delivery member may be stopped from transporting the sheet member again in a state of maintaining the contact between the sheet member and the fixing belt. As a result, the friction with the fixing belt occurs at two portions of the sheet member, so that the deterioration of image quality caused by edge flaws of the fixing belt 74 is further prevented, as compared with the friction occurs at one portion of the sheet member.

In addition, in the exemplary embodiments described above, when the fixing device 34 continuously fixes toner images to 300 A4-size recording media P in the first mode, and when the printing job ends, the first mode is switched to the second mode. However, when the fixing device 34 continuously fixes toner images to the 300 A4-size recording media P, the first mode may be switched to the second mode even during the printing job.

In addition, in the exemplary embodiments described above, when the fixing device 34 continuously fixes toner images to 300 A4-size recording media P in the first mode, and when the printing job ends, the first mode is switched to the second mode. However, toner images may not be continuously fixed to the 300 recording media, and toner images may be fixed to recording media having a different width from that of the 300 recording media in the middle of fixing toner images to the 300 recording media. Accordingly, the operation achieved by switching the first mode to the second mode after toner images are continuously fixed to the 300 recording media P is not achieved. However, the first mode is switched to the second mode when edge flaws are highly likely to occur in the fixing belt 74, as compared with a case where the first mode is switched to the second mode based on only the number of recording media P to which toner images have been fixed. In other words, the number of times for switching the first mode to the second mode is reduced.

In addition, in the exemplary embodiments described above, the peripheral speed of the fixing belt 74 in the first mode is maintained in the second mode. However, the peripheral speed of the fixing belt 74 in the second mode may be made faster than the peripheral speed of the fixing belt 74 in the first mode. In this case, the time of the second mode is set to be shorter than that in a case where the peripheral speed of the fixing belt 74 in the first mode is maintained in the second mode.

In addition, in the exemplary embodiments described above, the embossed sheet S having concave-convex patterns is used in the second mode. However, a plain paper may be used in the second mode. In order to achieve the operation achieved by using the embossed sheet S when the plain paper is used, the time during which the fixing belt 74 circulates needs to be made longer than that when the embossed sheet S is used.

In addition, although not specifically described in the exemplary embodiments above, the sheet member used in the second mode may be supplied from the manual feed tray 38.

In addition, in the exemplary embodiments described above, when the fixing device 34 fixes toner images to 300 A4-size recording media P. and when the printing job ends, the first mode is switched to the second mode. However, the fixing device 34 may continuously fix toner images to a predetermined number of recording media P having a predetermined width. In this case, recording media having a width other than the A4 size may be used, and the number of recording media may not be 300.

In addition, although not specifically described in the exemplary embodiments above, edge flaws easily occur in the fixing belt 74 when a relatively thick paper is used as the recording medium, as compared with a case where a relatively thin paper is used. Thus, the number of recording media which is necessary for switching the first mode to the second mode may be changed according to the basis weight of a recording medium to be used.

In addition, although not specifically described in the exemplary embodiments above, a sheet member on which an image is not formable and which is dedicated for the second mode may be used as the embossed sheet S.

In addition, although not specifically described in the second exemplary embodiment, the recommending unit 230 that has been turned off may be turned on, for example, when the fixing device 34 continuously fixes toner images to 250 recording media P having the same size and the printing job ends.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a fixing device comprising:

a heating unit configured to contact a recording medium, onto which an image is transferred, and which is transported, so as to heat the recording medium while rotating; and a pressurizing unit configured to press the recording medium against the heating unit, wherein the fixing device is configured to fix the image to the recording medium; and a controller configured to control switching between a first mode for fixing the image to the recording medium and a second mode for making a transport speed of a sheet member that passes through the fixing device slower than a peripheral speed of the heating unit, wherein the controller is configured to, in the second mode, make a pressing force of the pressurizing unit weaker than that in the first mode.

2. The image forming apparatus according to claim 1, wherein the controller is configured to, in the second mode, cause the sheet member, having a maximum width up to which an image is formable, to pass through the fixing device.

3. The image forming apparatus according to claim 1, further comprising:

a delivery member configured to deliver the recording medium to the fixing device while rotating in a state of sandwiching the recording medium, wherein the controller is configured to, in the second mode, make a transport speed at which the delivery member transports the sheet member slower than the peripheral speed of the heating unit.

4. The image forming apparatus according to claim 3, wherein the controller is configured to, in the second mode, stop the delivery member from transporting the sheet member.

5. The image forming apparatus according to claim 4, wherein the controller is configured to, in the second mode, after stopping the delivery member from transporting the sheet member, cause the delivery member to transport the sheet member, and stop the delivery member from transporting the sheet member again in a state where a contact between the sheet member and the heating unit is maintained.

6. The image forming apparatus according to claim 1, wherein the controller is configured to, if the fixing device fixes images to a predetermined number of recording media having a predetermined width in the first mode and a printing job ends, then switch the first mode to the second mode.

7. The image forming apparatus according to claim 6, wherein the controller is configured to, if the fixing device continuously fixes the images to the predetermined number of recording media having the predetermined width in the first mode and the printing job ends, then switch the first mode to the second mode.

8. The image forming apparatus according to claim 1, further comprising:

an input unit configured to switch the first mode to the second mode according to an input by a user.

9. The image forming apparatus according to claim 8, further comprising:

an inspecting unit configured to inspect a quality of the image fixed to the recording medium by the fixing device; and a recommending unit configured to recommend the user to switch the first mode to the second mode based on an inspection result of the inspecting unit.

10. The image forming apparatus according to claim 1, further comprising:

an accommodating unit configured to accommodate an embossed sheet, wherein the controller is configured to, in the second mode, cause the sheet member accommodated in the accommodating unit to pass through the fixing device.

11. The image forming apparatus according to claim 2, further comprising:

an accommodating unit configured to accommodate an embossed sheet, wherein the controller is configured to, in the second mode, cause the sheet member accommodated in the accommodating unit to pass through the fixing device.

12. The image forming apparatus according to claim 3, further comprising:

an accommodating unit configured to accommodate an embossed sheet, wherein the controller is configured to, in the second mode, cause the sheet member accommodated in the accommodating unit to pass through the fixing device.

13. The image forming apparatus according to claim 4, further comprising:

an accommodating unit configured to accommodate an embossed sheet, wherein the controller is configured to, in the second mode, cause the sheet member accommodated in the accommodating unit to pass through the fixing device.

14. The image forming apparatus according to claim 5, further comprising:

an accommodating unit configured to accommodate an embossed sheet, wherein the controller is configured to, in the second mode, cause the sheet member accommodated in the accommodating unit to pass through the fixing device.

15. The image forming apparatus according to claim 6, further comprising:

an accommodating unit configured to accommodate an embossed sheet, wherein the controller is configured to, in the second mode, cause the sheet member accommodated in the accommodating unit to pass through the fixing device.

16. The image forming apparatus according to claim 7, further comprising:

an accommodating unit configured to accommodate an embossed sheet, wherein the controller is configured to, in the second mode, cause the sheet member accommodated in the accommodating unit to pass through the fixing device.

17. An image forming apparatus comprising:

a fixing device comprising:

a heating unit configured to contact a recording medium, onto which an image is transferred, and which is transported, so as to heat the recording medium while rotating; and a pressurizing unit configured to press the recording medium against the heating unit, wherein the fixing device is configured to fix the image to the recording medium; and a controller configured to control switching between a first mode for fixing the image to the recording medium and a second mode for making a transport speed of a sheet member that passes through the fixing device slower than a peripheral speed of the heating unit, wherein the controller is configured to make the peripheral speed of the heating unit in the second mode faster than the peripheral speed of the heating unit in the first mode.

18. An image forming apparatus comprising:

a fixing means comprising:

a heating means for contacting a recording medium, onto which an image is transferred, and which is transported, so as to heat the recording medium while rotating; and a pressurizing means for pressing the recording medium against the heating means, wherein the fixing means is for fixing the image to the recording medium; and a control means for controlling switching between a first mode for fixing the image to the recording medium and a second mode for making a transport speed of a sheet member that passes through the fixing means slower than a peripheral speed of the heating means, wherein the control means is for, in the second mode, making a pressing force of the pressurizing means weaker than that in the first mode.

19. An image forming apparatus comprising:

a fixing device comprising:

a heater configured to contact a recording medium, onto which an image is transferred, and which is transported, so as to heat the recording medium while rotating; and a pressure roller configured to press the recording medium against the heating unit, wherein the fixing device is configured to fix the image to the recording medium; and a controller configured to control switching between a first mode for fixing the image to the recording medium and a second mode for making a transport speed of a sheet member that passes through the fixing device slower than a peripheral speed of the heating unit, wherein the controller is configured to, in the second mode, make a pressing force of the pressure roller weaker than that in the first mode.

* * * * *